United States Patent [19]

Kurosawa et al.

[11] Patent Number: 4,973,963

[45] Date of Patent: Nov. 27, 1990

[54] FLAT LATTICE FOR ABSORBING ELECTROMAGNETIC WAVE

[75] Inventors: Moriyoshi Kurosawa; Kazuo Wakabayashi; Tsutomu Miyata; Hiroyuki Tokita; Yoshiyuki Kitakoga; Yasuo Mizuno; Masaki Hikida; Tohimasa Hayashi, all of Tokyo, Japan

[73] Assignee: Seiko Instuments Inc., Japan

[21] Appl. No.: 273,359

[22] Filed: Nov. 18, 1988

[51] Int. Cl.[5] ..... H01Q 17/00; H01P 1/22

[52] U.S. Cl. ..... 342/4; 333/81 B

[58] Field of Search ..... 333/22 R, 81 B, 251; 342/1, 4

[56] References Cited

U.S. PATENT DOCUMENTS

| | | | |
|---|---|---|---|
| 2,527,918 | 10/1950 | Collard | 342/4 X |
| 2,875,418 | 2/1959 | Rolfs | 333/81 B |
| 2,985,880 | 5/1961 | McMillon | 342/4 X |
| 3,124,798 | 3/1964 | Zinke | 342/4 |
| 3,381,510 | 4/1983 | Wren | 342/1 X |
| 4,661,787 | 4/1987 | Lang | 333/81 B X |

FOREIGN PATENT DOCUMENTS

| | | | |
|---|---|---|---|
| 1165697 | 3/1964 | Fed. Rep. of Germany | 333/22 R |

*Primary Examiner*—Paul Gensler

*Attorney, Agent, or Firm*—Bruce L. Adams; Van C. Wilks

[57] ABSTRACT

A plurality of waveguide elements are arranged to form an electromagnetic wave absorbing lattice in opposed relation to the advancing wave surface of the incident electromagnetic wave. Each waveguide element has a front opening on the lattice receptive of a part of the incident electromagnetic wave, a rear end portion spaced rearwardly from the front opening, and an inner peripheral surface portion extending between the front opening and the rear end portion to define a cavity effective to wave-guide the received electromagnetic wave. The inner peripheral surface portion has a given electric resistivity to effect absorption of the received electromagnetic wave during the wave-guiding thereof without substantial reflection thereof.

18 Claims, 3 Drawing Sheets

FLAT LATTICE FOR ABSORBING ELECTROMAGNETIC WAVE

BACKGROUND OF THE INVENTION

1. Field of the Invention

The present invention relates to electromagnetic wave absorbing devices of flat lattice type suitable to cover a ceiling, sidewalls and a floor to construct a perfect electromagnetical non-echo room.

2. Prior Art

One of the known electromagnetic wave absorbing devices is shown in FIG. 12 and comprises a plurality of ferrite tiles 21 arranged in a matrix to cover electrically shielding sidewalls 22 of a housing. However, ferrite tile cannot suppress completely the reflection of incident electromagnetic wave at the surface of the tile. Moreover, the range of wavelength to be absorbed is limited due to the specific characteristics of ferrite.

Another of the known electromagnetic wave absorbing devices is shown in FIG. 13 and comprises a plurality of pyramid blocks 23, each having a square base, and being arranged in a matrix to cover an electrically shielding sidewall 22 of a housing. Each block 23 is composed of plastic foam containing carbon black powder and is attached to the shielding inner wall of the housing by means of electro-conductive adhesive to form the matrix of pyramids. Accordingly, there are large spaces between adjacent pyramids to reduce the absorption efficiency. Each pyramid body is needed to have a height from 70 cm to 100 cm to obtain a sufficient absorption rate. Moreover, when each pyramid is attached to the sidewalls to extend horizontally, the tip end portion of the pyramid tends to deform due to its own weight. The pyramid, bodies also occupy a considerable peripheral space of the room thereby reducing the effective center space of the electromagnetical non-echo room, or electromagnetical black room.

SUMMARY OF THE INVENTION

An object of the present invention is to provide an electromagnetic wave absorbing device of flat lattice structure effective to absorb a broad wavelength range of incident electromagnetic wave. Another object of the present invention is to form front edges of the lattice structure opposed to the advancing wave face of the incident wave into a knife-edge shape effective to suppress the reflection of the incident wave at the front face the lattice. A further object of the present invention is to provide a plurality of waveguide cavities in the lattice formed with a resistive lining layer having varying resistivity gradually decreasing in the direction of wave-guiding, effective to perfectly absorb the wave-guided electromagnetic wave. A still further object of the present invention is to superpose a plurality of lattices with each other to improve the efficiency of electromagnetic wave absorption. Another object of the present invention is to align the openings of the lattice with the incident polarized electromagnetic wave to efficiently absorb the same.

DETAILED DESCRIPTION OF THE INVENTION

Figure 1:
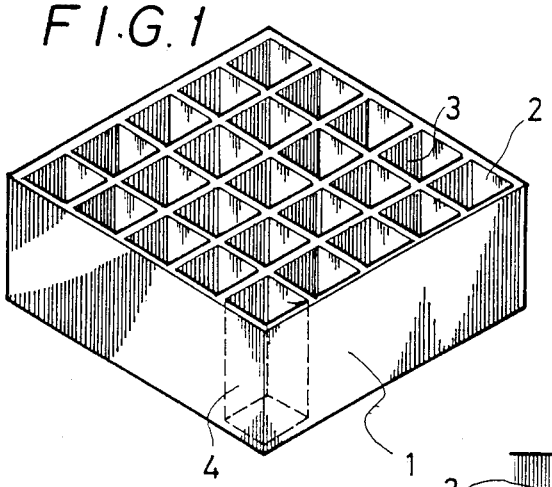
FIG. 1 is a perspective view of an electromagnetic absorbing device of flat lattice type.
Figure 2:
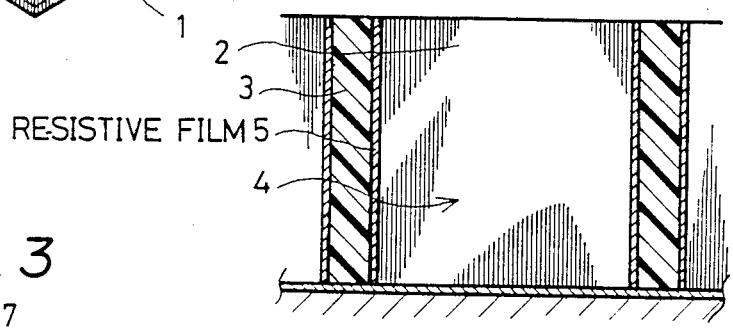
FIG. 2 is a sectional view of a waveguide element in the lattice shown in FIG. 1.

Hereinafter, various embodiments of the present invention will be explained in detail in conjunction with the attached drawings. As shown in FIG. 1, an electromagnetic wave absorption device 1 is comprised of rows of partition walls 2 and columns of partition walls 3 intersecting with each other to form a flat lattice and to define a plurality of wave-guide elements 4. As shown in FIG. 2, the inner peripheral sidewalls of the partitions 2 and 3 defining each wave-guide element 4 are covered with an electrically resistive film 5. Front ends of partitions 2 and 3 are not covered with the resistive film 5 so as to avoid reflection of incident electromagnetic wave. When the incident electromagnetic wave advances to the front face of the lattice, the incident wave is divided by the front edges of the partition walls 2,3 and guided to respective waveguide elements 4. As a result, the divided waves cause eddy currents in the resistive films 5 inside the respective waveguide elements 4 due to electromagnetic induction to convert the electromagnetic energy of the incident wave into thermal energy to thereby absorb the incident wave.

The flat lattice structure can be formed by means of plastic molding, and the resistive film can be formed on the inner peripheral surface of the partition walls by means of electroless plating, coating, or adhering thin films to the partition wall surfaces. The resistive film can be composed of materials such as electroconductive rubber and electroconductive plastic.

When the incident, electromagnetic wave approaches the front face of the lattice, the wave enters into the respective waveguide elements without substantial reflection to induce eddy currents all over the surface of resistive film disposed inside the waveguide elements to thereby efficiently absorb the incident wave without reflection. A plurality of the flat lattice devices can be attached to interior walls of a housing to construct an electromagnetical non-echo or black room. These flat lattice devices have considerably small thickness and small weight as compared to the conventional devices.

Figure 3:
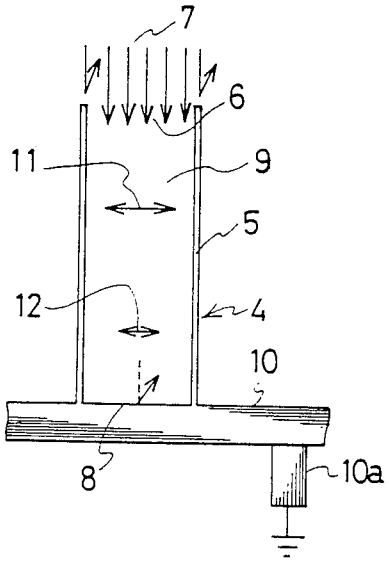
FIG. 3 is a sectional view of an individual waveguide element, showing the state of wave-guiding.

FIG. 3 shows an individual waveguide element 4. The plurality of individual waveguide elements 4 are arranged periodically in two dimensions to constitute a flat lattice. The individual waveguide element 4 has a front opening 6 receptive of a part of an incident electromagnetic wave 7, a rear end portion 8 spaced rearwardly from the front opening 6, and an inner peripheral surface defined by the resistive film 5 extending between the front opening 6 and the rear end portion 8 to define a cavity 9 effective to wave-guide therethrough the received incident electromagnetic wave 7. The resistive film 5 which defines the inner peripheral surface has a varying electric resistivity gradually decreasing in the direction of wave-guiding to effect efficient absorption of the incident wave. A grounded electro-conductive member 10 is attached to the rear end portions 8 of the individual waveguide elements 4 so as to close the cavity 9 to thereby avoid leaking of the incident wave the member 10 being grounded through a ground terminal 10a of column shape and which protrudes rearwardly from the member 10.

When the of wave face of incident electromagnetic wave 7 advances to the lattice opposed to the wave face, the incident wave 7 is divided and introduced into individual cavities 9. The introduced wave induces electric current 11 on the inner peripheral surface of the resistive film 5, which is converted into thermal energy in the form of Joule heat, to thereby lose its electromagnetic energy. Only a negligible fraction of the incident wave reaches the rear end portion 8. The fraction of incident wave which reaches the rear end portion 8 is reflected by the electro-conductive member 10 and reversely advances to induce electric current 12 on the inner peripheral surface of the resistive film 5 to thereby completely be absorbed.

Figure 4:
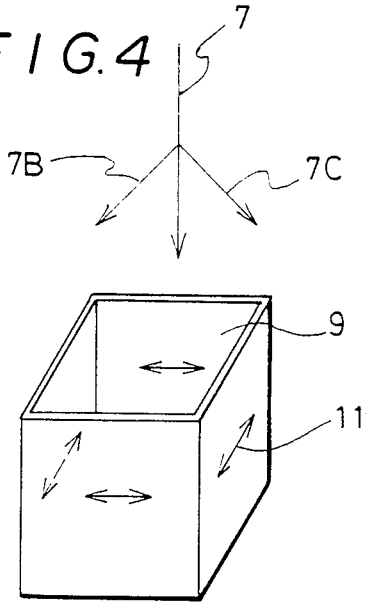
FIG. 4 is a perspective view of an individual waveguide element, showing the principle of FIG. 5 is a perspective view of another electromagnetic wave absorbing device of flat lattice type.

FIG. 4 shows the principle of electromagnetic wave absorption of the incident electromagnetic wave. An electric field vector 7B and a magnetic field vector 7C of the incident electromagnetic wave 7 enter into the cavity 9 with orthogonal relationship therebetween to induce eddy current 11 on each inner peripheral surface of the cavity 9. The electromagnetic wave 7 has a high frequency so that the induced eddy current 11 is of high frequency and therefore is dissipated as Joule heat.

As described above, the inner peripheral surface 5 of the cavity 9 has a varying electric resistivity gradually decreasing in the direction of wave-guiding. Such gradation of resistivity can be, for example, achieved by gradually increasing the thickness of the electro-resistive film formed on the inner peripheral surface in the direction of wave-guiding. For example, the surface resistivity is set to 3 K Ω at a front area adjacent to the front opening of cavity, set to 1 K Ω–0.3 K Ω at an intermediate area, and set to 0.1 K Ω at a rear area adjacent to the rear end of cavity. The wave absorption ability is accordingly graded due to the gradation of surface resistivity. Namely, the absorption ability is weak at the front area, moderate at the intermediate area, and strong at the rear area so as to establish impedance matching between the incident electromagnetic wave and the waveguide cavity along the length of the cavity to suppress the reflection and to improve the absorption rate.

When the incident electromagnetic wave reaches the flat lattice, the incident wave is introduced into the respective waveguide cavities without reflection at the front area, because the impedance matching is established. The incident wave is guided along the cavity and attenuated exponentially without reflection due to the gradation of the resistivity of the cavity inner surface to complete the absorption of the electromagnetic wave when the same reaches the shielding plate attached to the rear end of cavity. Accordingly, the reflection of the incident wave at the shielding is negligible.

Figure 5:
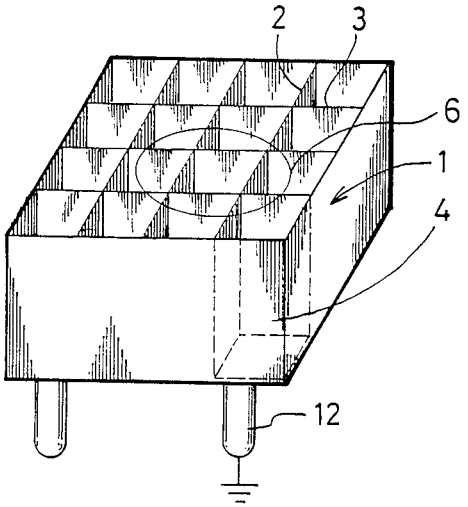
Figure 6:
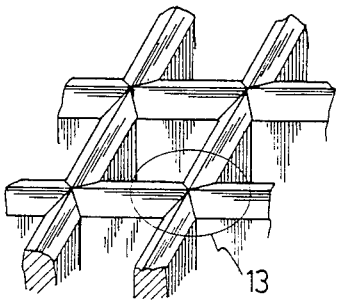
FIG. 6 is an enlarged partial perspective view of the device shown in FIG. 5, illustrating a front edge of the lattice.
Figure 7:
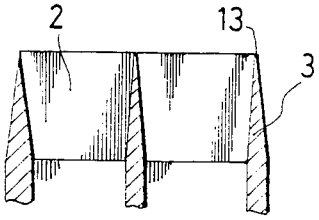
FIG. 7 is an enlarged partial sectional view of the device shown in FIG. 6, illustrating a knife edge shape of the lattice front end.

FIG. 5 shows another embodiment of the present invention. A flat lattice of an electromagnetic wave absorption device 1 is comprised of a plurality of intersecting partition walls 2 and 3, and a plurality of waveguide elements 4 having cavities and front openings 6. As shown in FIG. 6, the front edge portions 13 of the partitions 2 and 3 which surround the front opening 6 of the cavity are formed into a knife edge shape having no flat area opposed to the incident wave face. As shown in FIG. 7, the knife edge has a very sharp taper angle. When the incident electromagnetic wave approaches to the front face of the lattice 1, the incident wave face is perfectly divided by the knife edges 13 and introduced into the respective waveguide cavities to electromagnetically induce eddy currents on the resistive inner surfaces of the partitions 2, 3 to convert the electromagnetic radiation energy of the wave into thermal energy dissipated through a columnar ground terminal 12 of column shape connected to the earth. As described above, the front edge portions of the partition walls have a knife edge shape with very sharp taper angle effective to divide the incident wave without reflection thereof at the front face of the lattice. The entire amount of the incident wave is introduced into the waveguide cavities without reflection.

Figure 8:
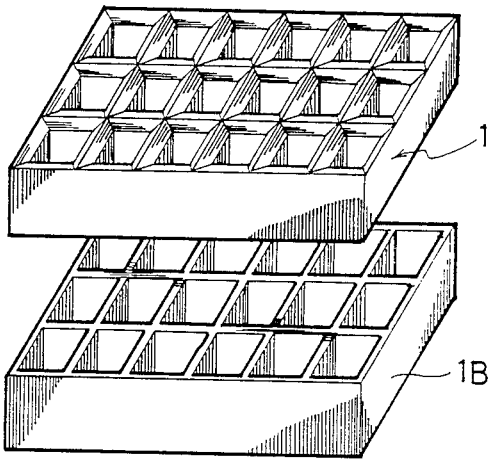
FIG. 8 is a perspective view of a further electromagnetic wave absorbing device of double-flat-lattice type.

As shown in FIG. 8, a first flat lattice 1 is superposed with a second flat lattice 1B to form an electromagnetic wave absorbing device. In this embodiment, the incident wave is successively absorbed by the first and second lattices 1 and 1B to complete the absorption as to avoid the reflection of the incident wave at the rear end portion of the second lattice 1B. A plurality of lattices are superposed with each other to obtain the desired absorption rate. Instead, the thickness of the flat lattice which corresponds to the waveguide length of the cavity may be set to adjust the absorption rate.

Figures 9A, 9B, 9C:
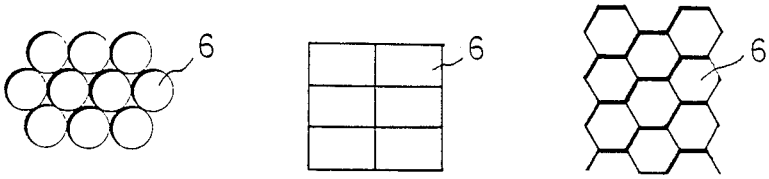
FIGS. 9A, 9B and 9C are plan views of flat lattices having various shapes of waveguide element openings.

FIGS. 9A, 9B and 9C show various shapes of the front openings formed on the flat lattice. The front opening 6 has a circular shape (FIG. 9A), a rectangular shape (FIG. 9B) or a hexagonal shape in honey-comb pattern (FIG. 9C). In any shape, the mean diameter of the front opening determines the maximum frequency of electromagnetic wave which can enter into the lattice. Namely, an incident electromagnetic wave having a wavelength more than twice the mean diameter of the opening can be admitted into the lattice. For example, a cavity having mean diameter of 200 mm can admit an electromagnetic wave of 30 MHz, and a cavity having mean diameter of 2 mm can admit an electromagnetic wave of 1000 MHz.

Figure 10:
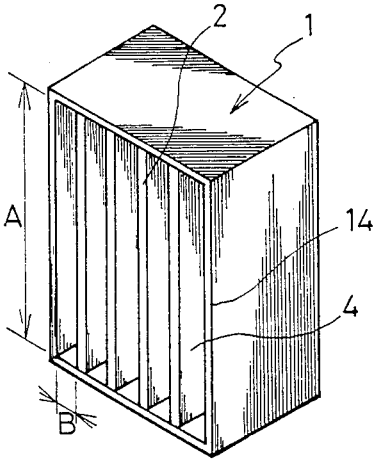
FIG. 10 is a perspective view of a further electromagnetic wave absorbing device suitable for selectively absorbing polarized electromagnetic wave.
Figure 11:
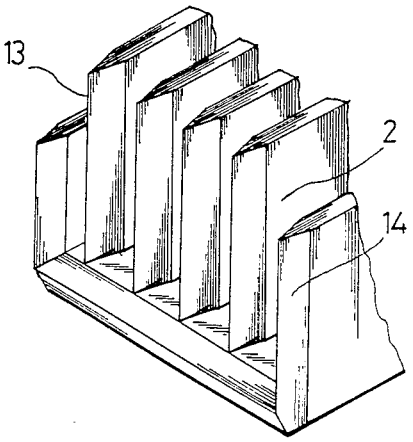
FIG. 11 is an enlarged partial perspective view of the device shown in FIG. 10.
Figure 12:
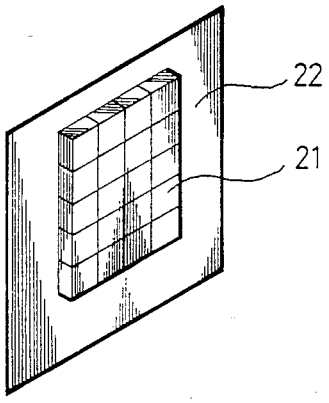
FIG. 12 is a perspective view of one type conventional electromagnetic absorbing device composed of ferrite tiles.
Figure 13:
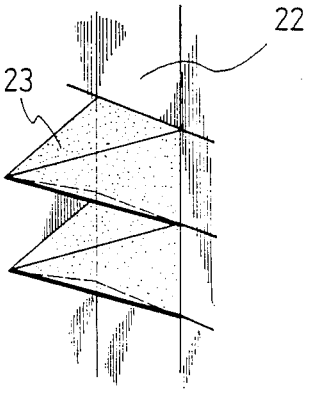
FIG. 13 is a perspective view of another type conventional electromagnetic absorbing device comprised of pyramid bodies.

FIG. 10 shows another embodiment of electromagnetic wave absorption device applicable for a polarized wave. The device 1 is comprised of a column of partition walls 2 spaced away from one another a given distance to define between adjacent partition walls an elongated waveguide element 4. The respective elements 4 have a front rectangular opening having a width B and a length A which is much greater than the width B. In this embodiment, the ratio of length A to width B is 10 : 1 . The device 1 is formed into a block of flat lattice by means of a frame 14 such that the plurality of blocks can be arranged to cover the entire interior surface of the housing. As shown in FIG. 11, the front ends 13 of partition walls 2 are formed into a knife edge shape to divide the incident wave and to introduce the divided fractions into respective elongated wave-guide elements 4. The elongated waveguide elements 4 are aligned vertically so as to selectively admit the horizontally polarized electromagnetic wave in this embodiment. Namely, the orientation of the elongated waveguide elements can be adjusted so as to selectively absorb the incident wave polarized in the specific direction. The absorbing device shown in FIG. 10 is designed to selectively absorb the horizontally and vertically polarized electromagnetic waves.

What is claimed is:

1. A device for absorbing electromagnetic waves, comprising: a plurality of waveguide elements arranged to form a lattice in opposed relation to an advancing wave surface of an incident electromagnetic wave, each waveguide element having a front opening, on the lattice, receptive of a part of the incident electromagnetic wave, a rear end portion spaced rearwardly from the front opening, and an inner peripheral surface portion extending between the front opening and the rear end portion to define a cavity effective to wave-guide therethrough the received incident electromagnetic wave, the inner peripheral surface portion being comprised of an electroless-plated electro-resistive film having a certain electric resistivity effective to absorb the incident electromagnetic wave during the wave-guiding thereof without substantial reflection thereof; and an electro-conductive member connected to the rear end portions of the waveguide elements and having a ground terminal of column shape protruding rearwardly therefrom and electrically connectable to ground during use of the device.

2. A device according to claim 1; wherein the electro-resistive film is composed of coating material selected from electro-conductive rubber and electro-conductive plastic.

3. A device according to claim 1;

wherein each wave-guide element has a front end portion surrounding the front opening and formed into a knife-edge shape.

4. A device according to claim 1;

wherein the front opening has a square shape.

5. A device according to claim 1;

wherein the front opening has a rectangular shape.

6. A device according to claim 1;

wherein the front opening has a circular shape.

7. A device according to claim 1;

wherein the front opening has a hexagonal shape.

8. A device according to claim 1;

including a first group of waveguide elements arranged to form a first lattice, and a second group of waveguide elements arranged to form a second lattice superposed on the first lattice.

9. A device according to claim 1;

including rows of partition walls, and columns of partition walls intersecting with the rows of partition walls to define the lattice.

10. A device according to claim 1;

including a row of partition walls spaced from one another a given distance to define between adjacent partition walls an elongated waveguide element oriented to register with an incident polarized electromagnetic wave.

11. A device for absorbing electromagnetic wave energy, comprising: a plurality of waveguide elements arranged in a two-dimensional array, each waveguide element having an open front end to receive therethrough incident electromagnetic wave energy, a closed rear end spaced from the front end, and a side wall interconnecting the front and rear ends and defining a wave-guiding cavity, and means including an electro-resistive film electroless-plated on the side wall for absorbing incident electromagnetic wave energy propagating through the cavity without substantial reflection thereof; and an electro-conductive member electrically connected to the rear ends of the waveguide elements, the electro-conductive member having a columnar ground terminal protruding rearwardly thereof and connectable to ground potential during use of the device.

12. A device according to claim 11, wherein the electro-resistive film electroless-plated on the side wall has an electric resistivity effective to absorb incident electromagnetic wave energy without substantial reflection thereof.

13. A device according to claim 11; wherein the rear ends of the waveguide elements are comprised of electro-conductive material.

14. A device according to claim 11; wherein the waveguide elements have a square-shaped cross section.

15. A device according to claim 11; wherein the waveguide elements have a rectangular cross section.

16. A device according to claim 11; wherein the waveguide elements have a circular cross section.

17. A device according to claim 11; wherein the waveguide elements have a hexagonal cross section.

18. A device for absorbing electromagnetic wave energy, comprising: a plurality of waveguide elements arranged in a two-dimensional array, each waveguide element having an open front end to receive therethrough incident electromagnetic wave energy, a closed rear end spaced from the front end, and a side wall interconnecting the front and rear ends and defining a wave-guiding cavity, the front end portion of the side wall which defines the open front end of each waveguide element having a knife-edge shape, and means including an electro-resistive film electroless-plated on the side wall for absorbing incident electromagnetic wave energy propagating through the cavity without substantial reflection thereof; and an electro-conductive member electrically connected to the rear ends of the waveguide elements and connectable to ground potential during use of the device.

* * * * *